US010998658B2

(12) United States Patent
Nozaki et al.

(10) Patent No.: US 10,998,658 B2
(45) Date of Patent: May 4, 2021

(54) MALE TERMINAL FITTING AND FEMALE TERMINAL FITTING

(71) Applicants: AutoNetworks Technologies, Ltd., Mie (JP); Sumitomo Wiring Systems, Ltd., Mie (JP); SUMITOMO ELECTRIC INDUSTRIES, LTD., Osaka (JP)

(72) Inventors: Shinji Nozaki, Mie (JP); Yasuo Omori, Mie (JP)

(73) Assignees: AutoNetworks Technologies, Ltd.; Sumitomo Wiring Systems, Ltd.; Sumitomo Electric Industries, Ltd.

( * ) Notice: Subject to any disclaimer, the term of this patent is extended or adjusted under 35 U.S.C. 154(b) by 0 days.

(21) Appl. No.: 16/630,169

(22) PCT Filed: Jun. 21, 2018

(86) PCT No.: PCT/JP2018/023580
§ 371 (c)(1),
(2) Date: Jan. 10, 2020

(87) PCT Pub. No.: WO2019/012936
PCT Pub. Date: Jan. 17, 2019

(65) Prior Publication Data

US 2020/0169020 A1 May 28, 2020

(30) Foreign Application Priority Data

Jul. 12, 2017 (JP) ..... JP2017-136123

(51) Int. Cl.
*H01R 13/02* (2006.01)
*H01R 13/04* (2006.01)
(Continued)

(52) U.S. Cl.
CPC ..... *H01R 13/04* (2013.01); *H01R 13/11* (2013.01); *H01R 4/184* (2013.01)

(58) Field of Classification Search
CPC ..... H01R 13/04; H01R 13/11; H01R 4/184
(Continued)

(56) References Cited

U.S. PATENT DOCUMENTS 3,143,384 A * 8/1964 Senior, Jr. ..... H01R 4/54 439/282
5,015,195 A * 5/1991 Piriz ..... H01R 13/17 439/272
(Continued)

FOREIGN PATENT DOCUMENTS

JP 52-12149 3/1977
JP 7-037636 2/1995
(Continued)

OTHER PUBLICATIONS

International Search Report dated Jul. 17, 2018.

*Primary Examiner* — Abdullah A Riyami
*Assistant Examiner* — Vladimir Imas
(74) *Attorney, Agent, or Firm* — Gerald E. Hespos; Michael J. Porco; Matthew T. Hespos

(57) ABSTRACT

It is aimed to improve abrasion resistance. A tab (13) of a male terminal fitting (10) is resiliently sandwiched between a resilient pressing piece (34) and a pressure receiving portion (28) in a rectangular tube portion (23) of a female terminal fitting (21), whereby the male terminal fitting (10) and the female terminal fitting (21) are connected. A male conductive member (20) capable of resiliently contacting the pressure receiving portion (28) while rolling is mounted in the tab (13). The female terminal fitting (21) is provided with a female conductive member (36) capable of resiliently coming into contact with the tab (13) by biasing of the resilient pressing piece (34) and capable of contacting the tab (13) while rolling.

7 Claims, 8 Drawing Sheets

(51) Int. Cl.
*H01R 13/11* (2006.01)
*H01R 4/18* (2006.01)

(58) Field of Classification Search
USPC ..... 439/889
See application file for complete search history.

(56) References Cited

U.S. PATENT DOCUMENTS 5,649,842 A * 7/1997 Ohsumi ..... H01R 13/04 439/852
5,795,197 A * 8/1998 Tsuji ..... H01R 13/055 439/877
6,402,575 B1 * 6/2002 Suzuki ..... H01R 13/04 439/866
6,679,739 B2 * 1/2004 Fujita ..... H01R 13/11 439/637
6,790,106 B2 * 9/2004 Ito ..... H01R 13/04 439/866
6,905,376 B2 * 6/2005 Chen ..... H01R 13/04 439/595
7,238,064 B2 * 7/2007 Nakamura ..... H01R 13/04 439/884
7,513,806 B2 * 4/2009 Noda ..... H01R 13/04 439/852
7,594,832 B2 * 9/2009 Oka ..... H01R 13/03 439/884
9,270,043 B2 * 2/2016 Kobayashi ..... H01R 13/28
9,281,596 B2 * 3/2016 Endo ..... H01R 13/04
9,666,957 B2 * 5/2017 Endo ..... H01R 4/48
10,177,479 B2 * 1/2019 Saka ..... H01R 13/03

FOREIGN PATENT DOCUMENTS

JP 3444398 9/2003
JP 2015-165483 9/2015
JP 2015-210941 11/2015

* cited by examiner

MALE TERMINAL FITTING AND FEMALE TERMINAL FITTING

BACKGROUND

Field of the Invention

The invention relates to a male terminal fitting and a female terminal fitting.

Related Art

Japanese Unexamined Patent Publication No. 2015-165483 discloses overlapping an Ag—Bi alloy plating layer and a pure Ag-plating layer in a contact part of a terminal fitting for improving contact reliability and abrasion resistance in a structure for resiliently bringing a male terminal and a female terminal into contact.

However, the above-described plating layers still will abrade due to the sliding friction if the male terminal and female terminal frequently are inserted and withdrawn.

The invention was completed on the basis of the above situation and aims to improve abrasion resistance.

SUMMARY

A male terminal fitting according to a first aspect of the invention includes a tab to be inserted into a rectangular tube of a female terminal fitting. The male terminal fitting is connected to the female terminal fitting by having the tab resiliently sandwiched between a resilient pressing piece and a pressure receiving portion inside the rectangular tube. A conductive member mounted in the tab and is capable of resiliently contacting the pressure receiving portion or the resilient pressing piece while rolling.

A female terminal fitting according to a second aspect of the invention includes a rectangular tube having a resilient pressing piece and a pressure receiving portion provided inside. A tab of a male terminal fitting is inserted into the rectangular tube, and the female terminal fitting is connected to the male terminal fitting by resiliently sandwiching the tab between the resilient pressing piece and the pressure receiving portion. A conductive member is capable of resiliently contacting the tab by biasing the resilient pressing piece. The conductive member is capable of contacting the tab while rolling.

According to the first aspect of the invention, the conductive member contacts the pressure receiving portion or resilient pressing piece while rolling in the process of inserting or withdrawing the tab into or from the rectangular tube. Therefore friction resistance is smaller as compared to the case where the tab slides in contact with both the pressure receiving portion and the resilient pressing piece, and abrasion resistance is excellent. According to the second aspect of the invention, the conductive member contacts the tab while rolling in the process of inserting or withdrawing the tab into or from the rectangular tube. Therefore friction resistance is smaller as compared to the case where the tab slides in contact with both the resilient pressing piece and the pressure receiving portion, and abrasion resistance is excellent.

The first and second aspects of the invention may be such that the conductive member is a spherical body. According to this configuration, even if the tab is inserted into or withdrawn from the rectangular tube in an oblique direction, a rolling motion of the conductive member is not obstructed.

The first aspect of the invention may be such that the tab has a double-plate structure including a base plate configured to face the resilient pressing piece and an upper plate configured to face the pressure receiving portion. The upper plate is formed with a tapered holding hole configured to face the pressure receiving portion, and the conductive member is held in the tab while being in contact with the base plate and an inner peripheral surface of the holding hole. According to this configuration, the conductive member can be mounted stably inside the tab.

The second aspect of the invention may be such that the rectangular tube includes a holding portion to be disposed between the resilient pressing piece and the tab. The holding portion is formed with a tapered holding hole configured to face the tab, and the conductive member is held in the rectangular tube while being in contact with the resilient pressing piece and an inner peripheral surface of the holding hole. According to this configuration, the conductive member can be mounted stably in the rectangular tube.

DETAILED DESCRIPTION

First Embodiment

Figure 1:
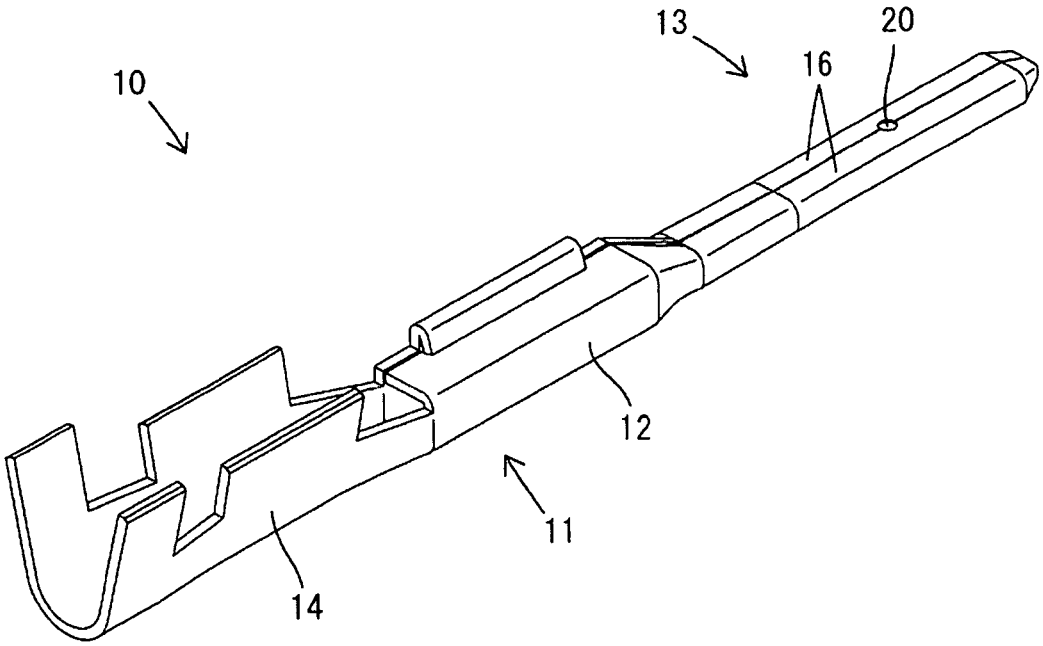
FIG. 1 is a perspective view of a male terminal fitting of a first embodiment.
Figure 2:
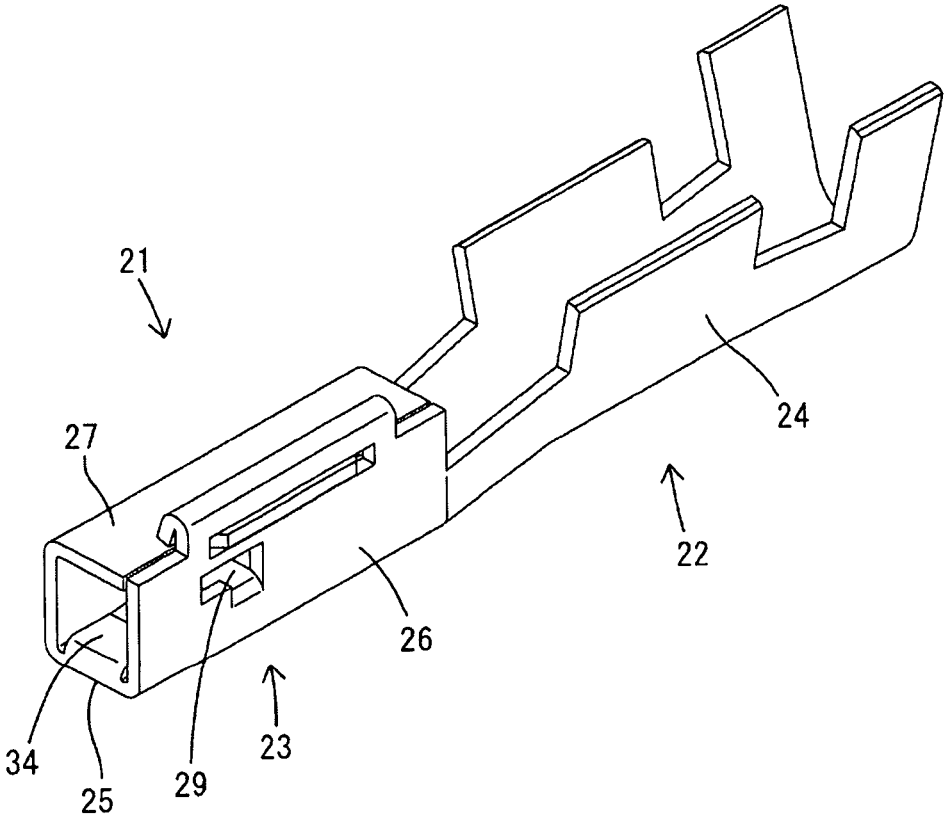
FIG. 2 is a perspective view of a female terminal fitting.
Figure 3:
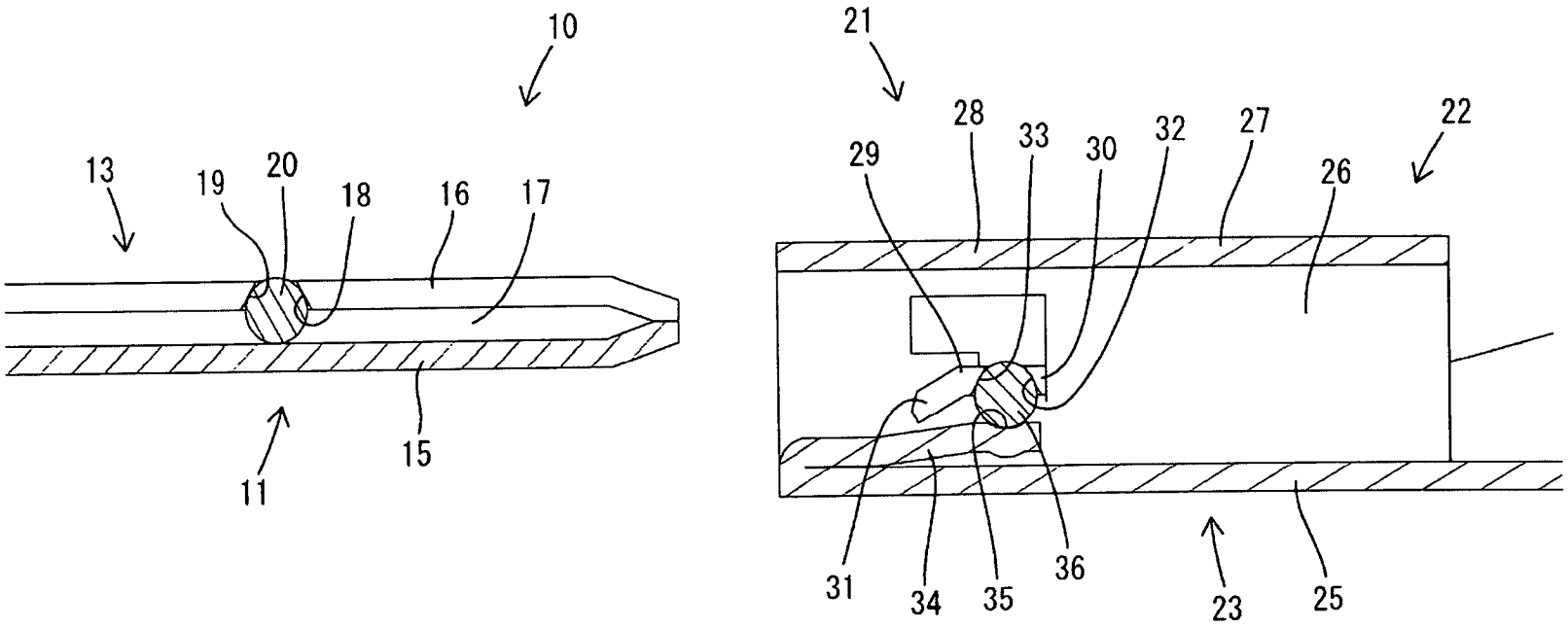
FIG. 3 is a partial enlarged side view in section showing a state before the male terminal fitting and the female terminal fitting are connected.
Figure 4:
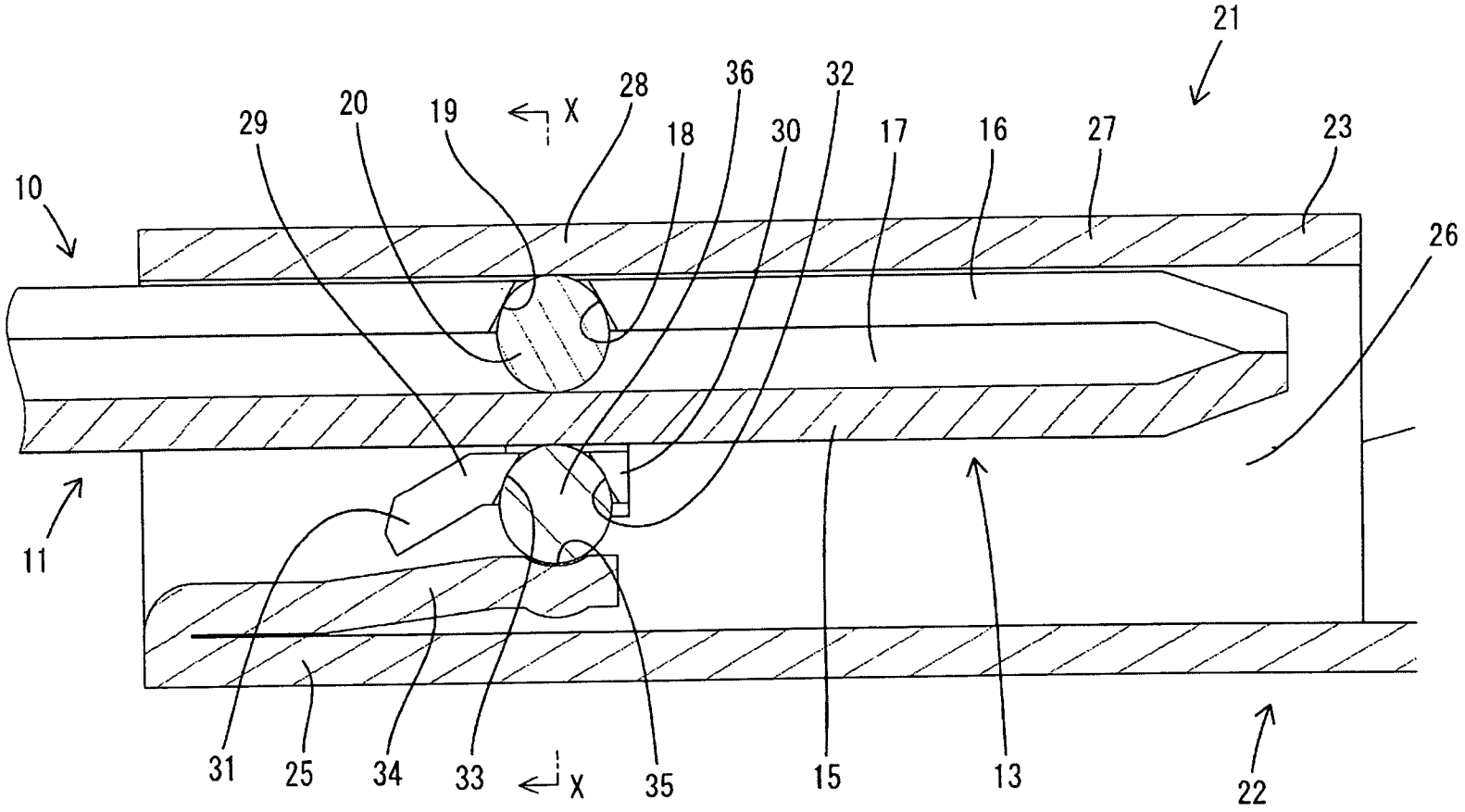
FIG. 4 is a partial enlarged side view in section showing a connected state of the male terminal fitting and the female terminal fitting.
Figure 5:
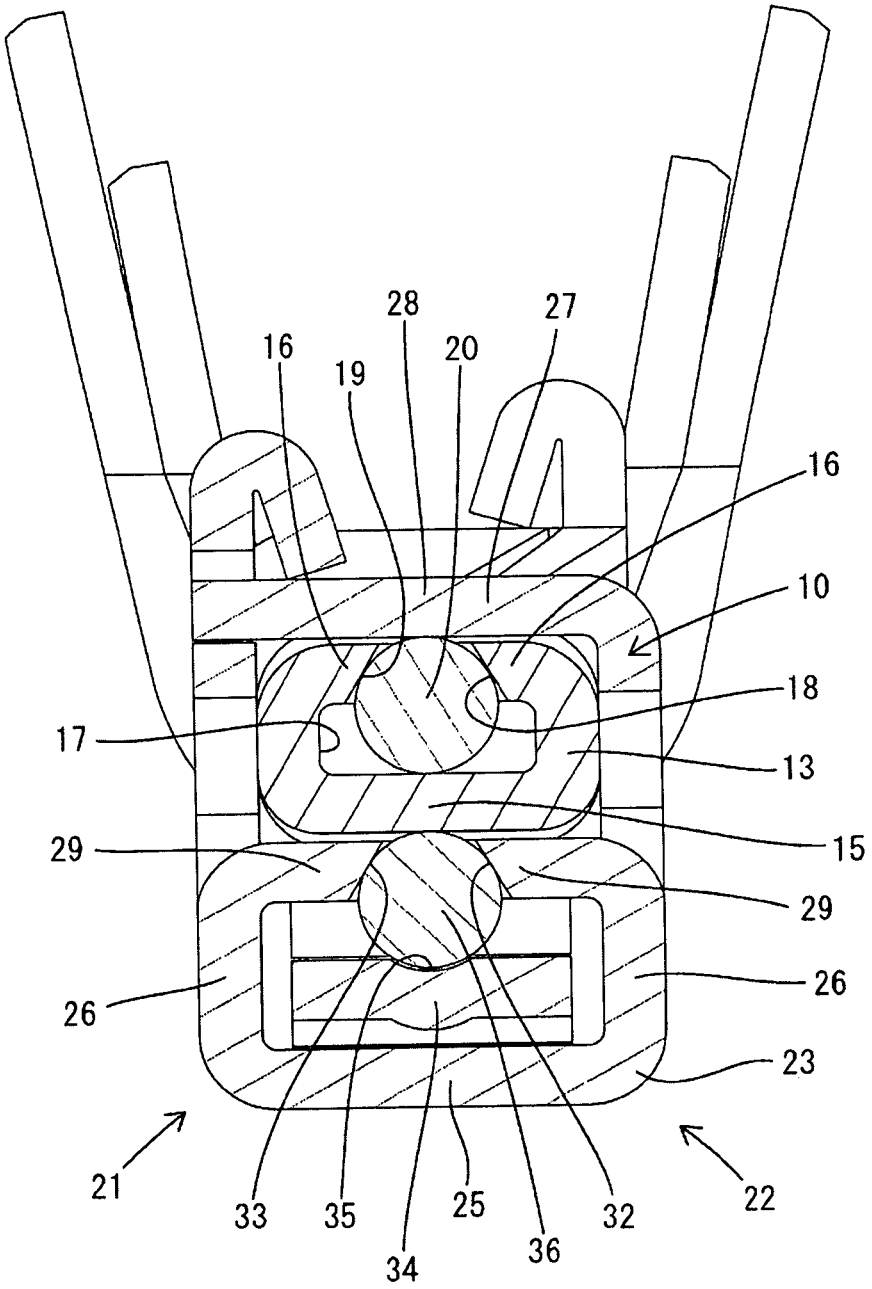
FIG. 5 is a section along X-X of FIG. 4.
Figure 6:
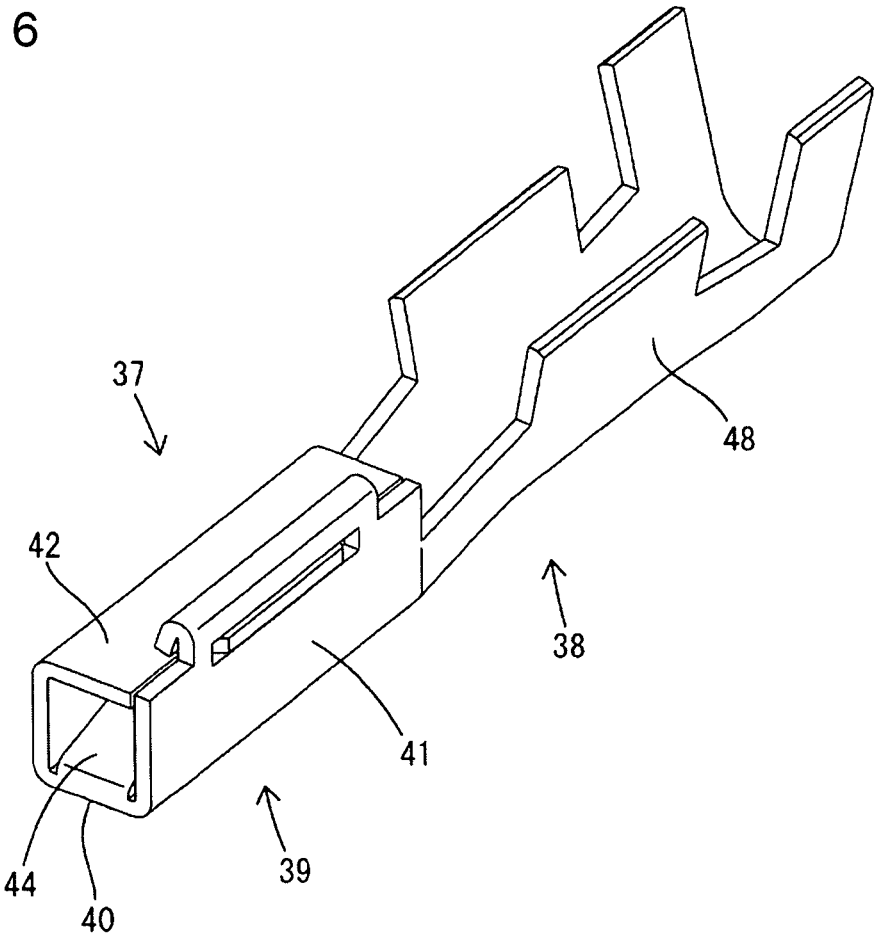
FIG. 6 is a perspective view of a female terminal fitting of a second embodiment.

A first embodiment of the invention is described with reference to FIGS. 1 to 5. A terminal connection structure of the first embodiment includes a male terminal fitting 10 and a female terminal fitting 21. In the first embodiment, a right side in FIGS. 1, 3 and 4 is defined as a front of the male terminal fitting 10 and a left side in FIGS. 1, 3 and 4 is defined as a front of the female terminal fitting 21 concerning a front-rear direction. Upper and lower sides shown in FIGS. 1 to 5 are defined as upper and lower sides concerning a vertical direction.

The male terminal fitting 10 is composed of two components including a male terminal body 11 and a male conductive member 20 (conductive member as claimed) mounted in the male terminal body 11. The male terminal body 11 is elongated in the front-rear direction by bending a metal plate material stamped into a predetermined shape.

A terminal body 12 in the form of a rectangular tube is formed in a substantially central part of the male terminal body 11 in the front-rear direction. An elongated tab 13 projecting forward from the terminal body portion 12 and is at a front end of the male terminal fitting 10. A crimping portion 14 in the form of an open barrel is at the rear end of the terminal body 12 and hence is at the rear end of the male terminal fitting 10. The crimping portion 14 is to be crimped to a front part of a wire (not shown).

The tab 13 includes a base plate 15 that is elongated in the front-rear direction and two bilaterally symmetrically upper plates 16 formed by bending parts extending from both left and right sides of the base plate 15 inwardly in a width direction (lateral direction). Extending end edges of the upper plate s 16 are in contact with or proximately facing each other in a lateral center of the tab 13. A hollow portion 17 is formed between the upper surface of the base plate 15 and the lower surfaces of the upper plates 16.

The left and right upper plates 16 are formed with male cutouts 18 by cutting substantially central parts in the front-rear direction of the extending end edges in contact with or proximately facing each other into a substantially semicircular shape. A male holding hole 19 (holding hole as claimed) substantially circular in a plan view is formed in the upper surface of the tab 13 by the opposed left and right male cutouts 18. The male holding hole 19 is open in the upper surface of the tab 13 and allows communication between a space above the tab 13 and the hollow portion 17. An inner diameter of the male holding hole 19 is smallest in the upper surface of the tab 13 and largest in the lower surfaces (surfaces facing the hollow portion 17) of the upper plate portions 16. Thus, the inner peripheral surface of the male holding hole 19 is tapered.

The male conductive member 20 is a spherical body made of a conductive material such as metal, and is embedded in the tab 13. An outer diameter of the male conductive member 20 is larger than the minimum inner diameter of the male holding hole 19 and smaller than the maximum inner diameter of the male holding hole 19. Further, the outer diameter of the male conductive member 20 is slightly larger than a height from the upper surface of the base plate 15 to the upper surface of the tab 13.

The male conductive member 20 is placed on the upper surface of the base plate 15, and an upper end part of the male conductive member 20 projects slightly up from the upper surface of the tab 13 in the male holding hole 19. In this way, the upward separation of the male conductive member 20 from the tab 13 is restricted and relatively large displacements thereof in the front-rear direction and lateral direction with respect to the tab 13 are restricted. The male conductive member 20 is relatively rotatable with respect to the tab 13 in a three-dimensional manner. When relatively rotating, the male conductive member 20 slides in contact with the upper surface of the base plate 15 and the inner peripheral surface of the male holding hole 19.

The female terminal fitting 21 is composed of two components including a female terminal body 22 and a female conductive member 36 (conductive member as claimed) mounted in the female terminal body 22. The female terminal body 22 is elongated in the front-rear direction and is formed by bending a metal plate material stamped into a predetermined shape.

A rectangular tube 23 is formed in a front area of the female terminal fitting 21 (female terminal body 22), and a crimping portion 24 in the form of an open barrel to be crimped to a front end part of a wire (not shown) is formed in a rear area of the female terminal fitting 21. The rectangular tube 23 includes a bottom wall 25 elongated in the front-rear direction, left and right side walls 26 rising up substantially at a right angle from both left and right sides of the bottom wall 25 and an upper wall 27 extending from an upper end edge of either one of the left and right side walls 26 and facing the bottom wall 25 substantially: in parallel. A substantially central part in the front-rear direction of the inner surface (lower surface) of the upper wall 27 serves as a pressure receiving portion 28. The pressure receiving portion 28 is in the form of a flat surface parallel to inserting and withdrawing directions of the tab 13 into and from the rectangular tube 23.

Left and right holding portions 29 are formed inside the rectangular tube 23. The holding portions 29 are formed by cutting and raising parts of the both left and right side walls 26 inward, and cantilevered to extend from the side walls 26 to a lateral center of the rectangular tube 23. The holding portions 29 are disposed in the same area as the pressure receiving portion 28 in the front-rear direction (inserting and withdrawing directions of the tab 13 into and from the rectangular tube 23). The holding portion 29 is composed of a horizontal holding plate 30 directly connected substantially at a right angle to the side wall 26, and a guiding plate 31 extending from the front end of the holding plate 30 to an oblique lower-front side.

Extending end edges of the left and right holding portions 29 opposite to the side walls 26 are positioned to contact or proximately face each other in the lateral center of the rectangular tube 23. The holding plates 30 are formed with female cutouts 32 by cutting the extending end edges in contact with or proximately facing each other into a substantially semicircular shape. The holding portions 29 are formed with a female holding hole 33 (holding hole as claimed) substantially circular in a plan view by the opposed left and right female cutouts 32. The female holding hole 33 penetrates through the holding portions 29 and is open in the upper and lower surfaces of the holding portions 29. An inner diameter of the female holding hole 33 is smallest in the upper surfaces of the holding portions 29 and largest in the lower surfaces of the holding portions 29. Thus, the inner peripheral surface of the female holding hole 33 is tapered.

A resilient pressing piece 34 is provided inside the rectangular tube 23. The resilient pressing piece 34 is formed by folding a part extending from the front end of the bottom wall 25 rearward, and is cantilevered to extend from a front end of the bottom wall 25 to an oblique upper-rear side. The resilient pressing piece 34 is resiliently displaceable in the vertical direction. The upper surface of an extending end part (rear end part) of the resilient pressing piece 34 is recessed spherically to form a holding recess 35. A curvature of the holding recess 35 is substantially equal to that of the outer surface of the female conductive member 36. The holding recess 35 is disposed at the same position as the female holding hole 33 in the front-rear direction and lateral direction.

The female conductive member 36 is a spherical body made of a conductive material, such as metal, and is provided in a state resiliently sandwiched between the holding portions 29 and the resilient pressing piece 34. An outer diameter of the female conductive member 36 is larger than the minimum inner diameter of the female holding hole 33 and smaller than the maximum inner diameter of the female holding hole 33. Further, the outer diameter of the female conductive member 36 is sufficiently larger than a height from the lowermost end of the holding recess 35 to the upper surfaces of the holding portions 29 (holding plates 30) in a state where the resilient pressing piece 34 is not resiliently displaced.

The female conductive member 36 is placed on the upper surface of the holding recess 35 with the resilient pressing piece 34 resiliently displaced down, and positioned with respect to the resilient pressing piece 34 in the front-rear direction and lateral direction. The female conductive member 36 placed in the holding recess 35 is pressed resiliently against the inner peripheral surface of the female holding hole 33 by a resilient restoring force (biasing) of the resilient pressing piece 34. An upper end part of the female conductive member 36 projects up from the upper surfaces of the holding plates 29 in the female holding hole 33.

With the female conductive member 36 held in contact with the inner peripheral surface of the female holding hole 33 by the biasing of the resilient pressing piece 34, a vertical interval between the upper end of the female conductive member 36 and the lower surface of the pressure receiving portion 28 is slightly smaller than a height from the lower surface of the tab 13 to the upper end of the male conductive member 20. The tab 13 of the male terminal fitting 10 is inserted between the upper end of the female conductive member 36 and the pressure receiving portion 28.

The upward separation of the female conductive member 36 from the holding portions 29 is restricted and large relative displacements thereof in the front-rear direction and lateral direction with respect to the holding portions 29 are restricted. The female conductive member 36 is relatively rotatable with respect to the rectangular tube 23 in a three-dimensionally manner. When relatively rotating with respect to the rectangular tube 23, the female conductive member 36 slides in contact with the upper surface of the holding recess 35 and the inner peripheral surface of the female holding hole 33.

In connecting the male terminal fitting 10 and the female terminal fitting 21, the tab 13 is inserted into the rectangular tube 23. The inserted tab 13 slides in contact with the upper surfaces of the guiding plates 31 of the holding portions 29, thereby being guided between the pressure receiving portion 28 and the holding portions 29. In the process of inserting the tab 13 between the pressure receiving portion 28 and the holding portions 29, the resilient pressing piece 34 presses the female conductive member 36 up by the biasing (resilient restoring force) thereof and the tab 13 presses the pressure receiving portion 28 upward via the male conductive member 20.

That is, the tab 13 is resiliently sandwiched between the resilient pressing piece 34 and the pressure receiving portion 28 via the male conductive member 20 and the female conductive member 36. The tab 13, the male conductive member 20 and the female conductive member 36 are sandwiched resiliently between the resilient pressing piece 34 and the pressure receiving portion 28. Thus, the upper end of the male conductive member 20 contacts the lower surface of the pressure receiving portion 28 while rolling and the upper end of the female conductive member 36 contacts the lower surface of the tab 13 while rolling in the inserting process of the tab 13.

Rolling friction when the male conductive member 20 rolls is smaller than friction caused when the male conductive member 20 is not provided and the tab 13 directly slides in contact with the pressure receiving portion 28. Rolling friction when the female conductive member 36 rolls is smaller than friction caused when the female conductive member 36 and the holding portions 29 are not provided and the tab 13 directly slides in contact with the resilient pressing piece 34.

If the tab 13 is inserted to a predetermined position in the rectangular tube 23, the male terminal fitting 10 and the female terminal fitting 21 are connected conductively. At this time, the resilient restoring force (biasing force) of the resilient pressing piece 34 directly acts on the female conductive member 36 and the female conductive member 36 resiliently contacts the tab 13. In this way, the tab 13 and the resilient pressing piece 34 are connected conductively via the female conductive member 36. Further, the male conductive member 20 resiliently contacts the tab 13 and the pressure receiving portion 28 due to a resilient pressing force of the female conductive member 36 pressing the tab 13. In this way, the tab 13 and the pressure receiving portion 28 are connected conductively via the male conductive member 20. The resilient pressing piece 34 and the tab 13 remain out of contact with each other.

As described above, the male terminal fitting 10 constituting the terminal connection structure of the first embodiment includes the tab 13 to be inserted into the rectangular tube 23 of the female terminal fitting 21. The female terminal fitting 21 constituting the terminal connection structure together with the male terminal fitting 10 includes the resilient pressing piece 34 and the pressure receiving portion 28 inside the rectangular tube 23. The tab 13 is sandwiched resiliently between the resilient pressing piece 34 and the pressure receiving portion 28 inside the rectangular tube 23 so that the male terminal fitting 10 and the female terminal fitting 21 are connected conductively.

The male conductive member 20 is mounted in the tab 13 and is capable of resiliently contacting the pressure receiving portion 28 while rolling. The female terminal fitting 21 is provided with the female conductive member 36 capable of resiliently contacting the tab 13 by the biasing of the resilient pressing piece 34. The female conductive member 36 contacts the tab 13 by the biasing of the resilient pressing piece 34 while rolling.

According to this configuration, in the process of inserting or withdrawing the tab 13 into or from the rectangular tube 23, the male conductive member 20 mounted in the tab 13 contacts the pressure receiving portion 28 while rolling, and the female conductive member 36 biased by the resilient pressing piece 34 contacts the tab 13 while rolling. Thus, as compared to the case where the tab 13 slides in contact with both the pressure receiving portion 28 and the resilient pressing piece 34, friction resistance is smaller in the terminal connection structure of the first embodiment. In this way, even if the tab 13 is inserted frequently into and withdrawn from the rectangular tube 23, the abrasion of plating layers of the tab 13, the pressure receiving portion 28 and the resilient pressing piece 34 is reduced. Therefore, the male terminal fitting 10 and the female terminal fitting 21 of the first embodiment are excellent in abrasion resistance.

Further, the male conductive member 20 is a spherical body. Thus, even if the tab 13 is inserted into or withdrawn from the rectangular tube 23 in an oblique direction, the male conductive member 20 can continue to roll with an axis of rotation inclined with respect to the lateral direction. Thus, a rolling motion of the male conductive member 20 is not obstructed. Similarly, the female conductive member 36 also is a spherical body. Thus, even if the tab 13 is inserted into or withdrawn from the rectangular tube 23 in an oblique direction, the female conductive member 36 can continue to roll with an axis of rotation inclined with respect to the lateral direction. Thus, a rolling motion of the female conductive member 36 is not obstructed.

Further, the tab 13 of the male terminal fitting 10 has a double-plate structure including the base plate 15 configured to face the resilient pressing piece 34 and the upper plates 16 configured to face the pressure receiving portion 28. The upper plates 16 are formed with the tapered male holding hole 19 configured to face the pressure receiving portion 28, and the male conductive member 20 is held in the tab 13 while being in contact with the base plate 15 and the inner peripheral surface of the male holding hole 19. According to this configuration, the male conductive member 20 is mounted stably inside the tab 13.

Further, the rectangular tube 23 includes the holding portions 29 to be disposed between the resilient pressing piece 34 and the tab 13. The holding portions 29 are formed with the tapered female holding hole 33 configured to face the tab 13, and the female conductive member 36 is held in the rectangular tube 23 while being in contact with the resilient pressing piece 34 and the inner peripheral surface of the female holding hole 33. According to this configuration, the female conductive member 36 is mounted stably in the rectangular tube portion 23.

Second Embodiment

Figure 7:
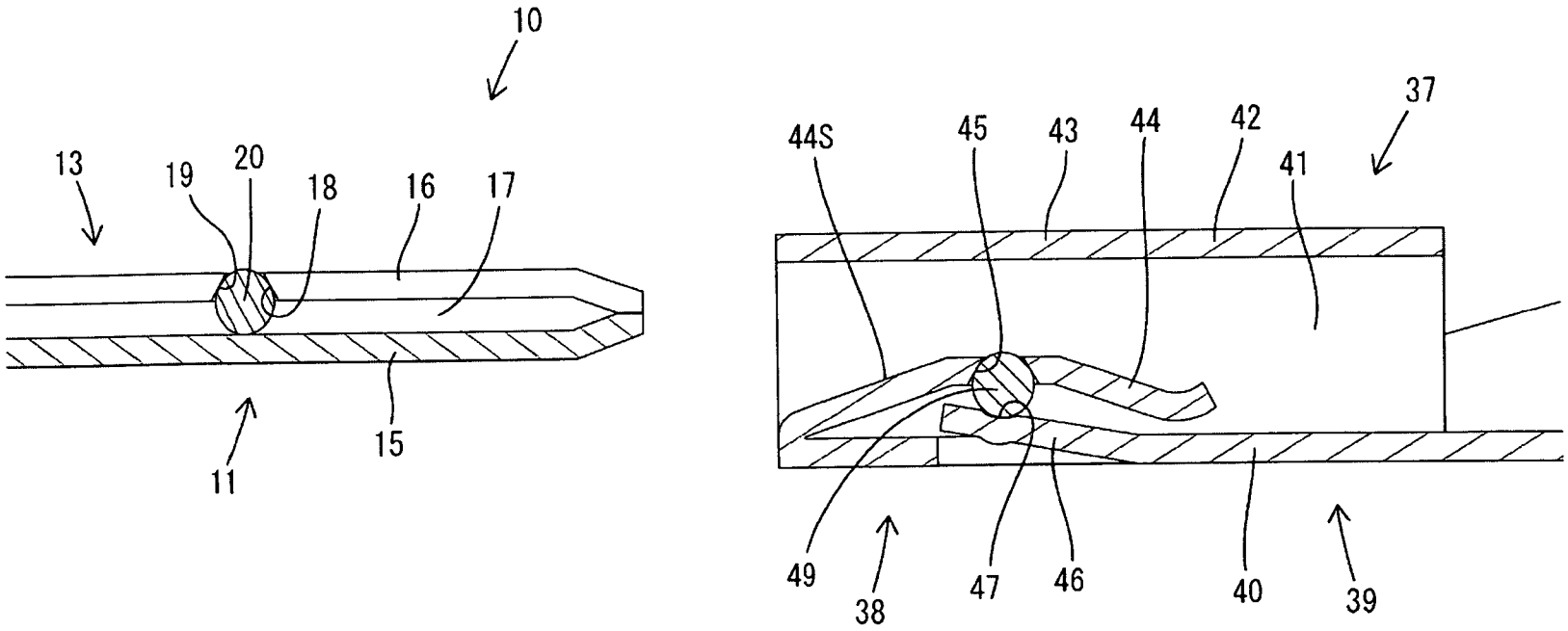
FIG. 7 is a partial enlarged side view in section showing a state before a male terminal fitting and the female terminal fitting are connected.
Figure 8:
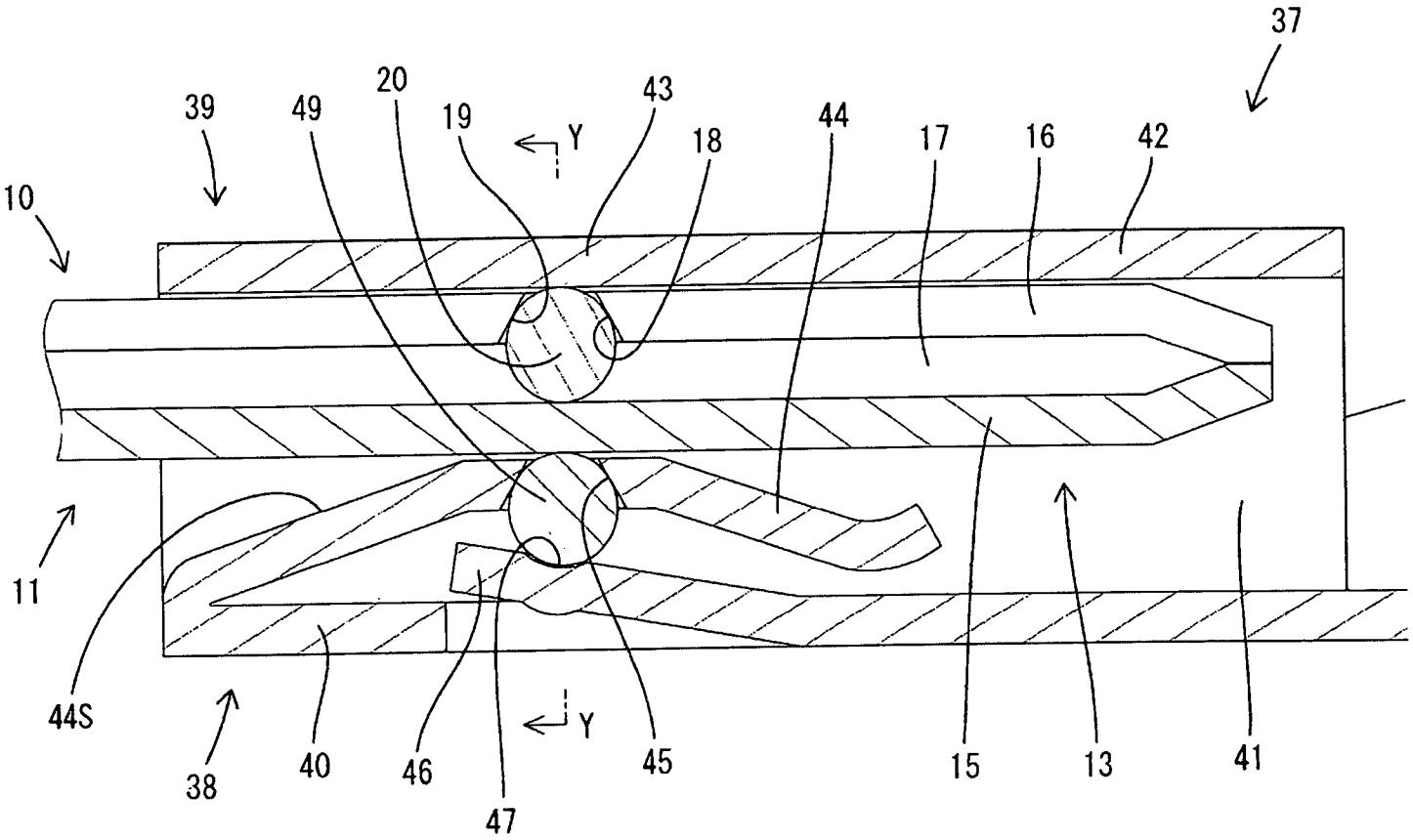
FIG. 8 is a partial enlarged side view in section showing a connected state of the male terminal fitting and the female terminal fitting.
Figure 9:
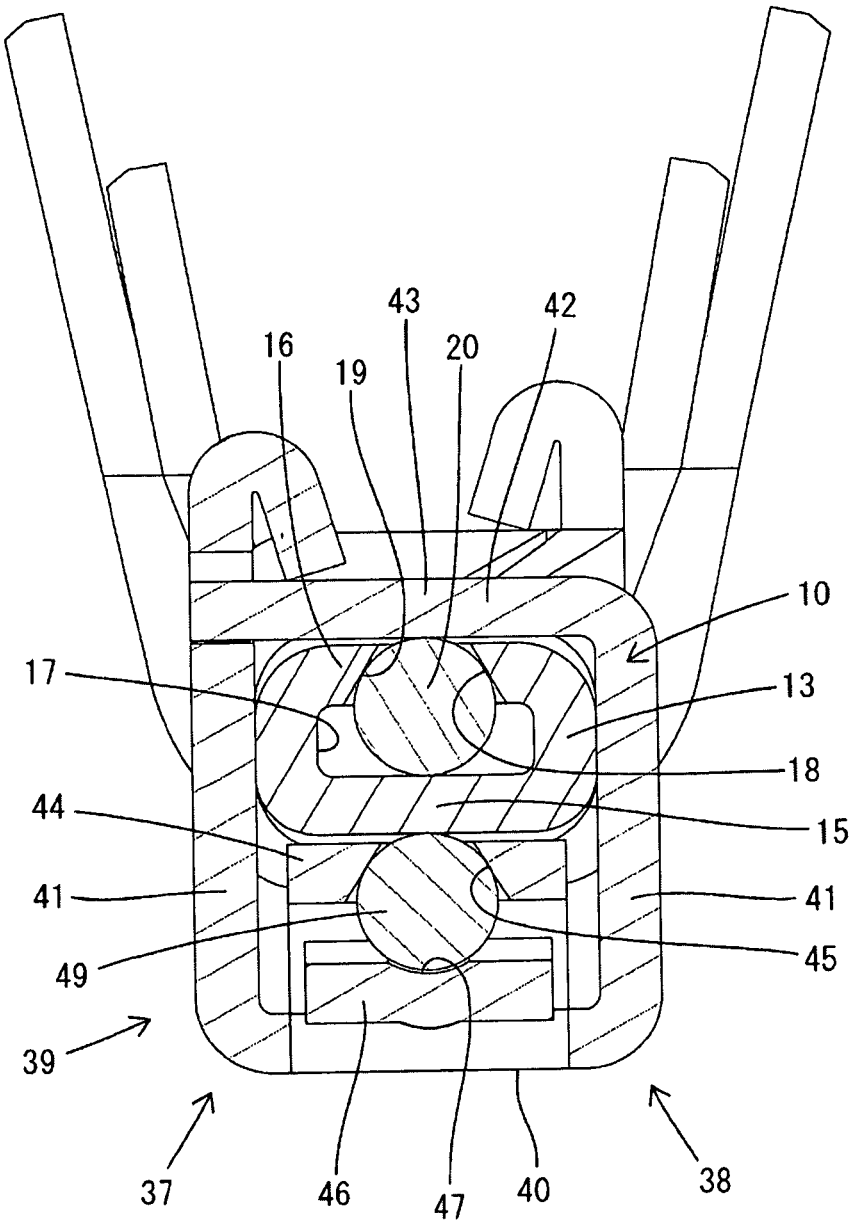
FIG. 9 is a section along Y-Y of FIG. 8.

Next, a second embodiment of the invention is described with reference to FIGS. 6 to 9. A terminal connection structure of the second embodiment includes the same male terminal fitting 10 as in the first embodiment and a female terminal fitting 37 different from that of the first embodiment. In the second embodiment, a right side in FIGS. 7 and 8 is defined as a front of the male terminal fitting 10 and a left side in FIGS. 7 and 8 is defined as a front of the female terminal fitting 37 concerning a front-rear direction. Upper and lower sides shown in FIGS. 6 to 9 are defined as upper and lower sides concerning a vertical direction.

The female terminal fitting 37 is composed of two components including a female terminal body 38 and a female conductive member 49 (conductive member as claimed) mounted in the female terminal body 38. The female terminal body 38 is elongated in the front-rear direction by bending a metal plate material stamped into a predetermined shape.

A rectangular tube 39 is formed in a front area of the female terminal fitting 37 (female terminal body 38), and a crimping portion 48 in the form of an open barrel to be crimped to a front end part of a wire (not shown) is formed in a rear area of the female terminal fitting 37. The rectangular tube 39 includes a bottom wall 40 elongated in the front-rear direction, left and right side walls 41 rising up substantially at a right angle from both left and right sides of the bottom wall 40 and an upper wall 42 extending from an upper end of either one of the left and right side walls 41 and facing the bottom wall 40 substantially in parallel. A substantially central part in the front-rear direction of the inner surface (lower surface) of the upper wall 42 serves as a pressure receiving portion 43. The pressure receiving portion 43 is in the form of a flat surface parallel to inserting and withdrawing directions of the tab 13 into and from the rectangular tube 39.

A resilient holding piece 44 is formed inside the rectangular tube 39. The resilient holding piece 44 is formed by folding a part extending from the front end of the bottom wall 40 rearward, and cantilevered to extend from a front part of the bottom wall 40 to an oblique upper rear. The resilient holding piece 44 has a chevron side view shape high in a central part in the front-rear direction. The resilient holding piece 44 is resiliently displaceable in the vertical direction.

The resilient holding piece 44 is formed with a female holding hole 45 that is substantially circular in a plan view. The female holding hole 45 penetrates through the resilient holding piece 44 and is open in the upper and lower surfaces of the resilient holding piece 44. An inner diameter of the female holding hole 45 is smallest in the upper surface of the resilient holding piece 44 and largest in the lower surface of the resilient holding piece 44. Thus, the inner peripheral surface of the female holding hole 45 is tapered. The female holding hole 45 is disposed in the same area as the pressure receiving portion 43 in the front-rear direction (inserting and withdrawing directions of the tab 13 into the rectangular tube 39).

A resilient pressing piece 46 is provided inside the rectangular tube 39. The resilient pressing piece 46 is formed by striking a part of an area of the bottom wall 40 covered by the resilient holding piece 44 upward, and cantilevered to extend to an oblique upper-front side. The resilient pressing piece 46 is resiliently displaceable in the vertical direction. The upper surface of an extending end of the resilient pressing piece 46 is recessed spherically to form a holding recess 47. A curvature of the holding recess 47 is substantially equal to that of the outer surface of the female conductive member 49. The holding recess 47 is disposed at the same position as the female holding hole 45 in the front-rear direction and lateral direction.

The female conductive member 49 is a spherical body made of a conductive material, such as metal, and is provided in a state resiliently sandwiched between the resilient holding piece 44 and the resilient pressing piece 46. An outer diameter of the female conductive member 49 is larger than the minimum inner diameter of the female holding hole 45 and smaller than the maximum inner diameter of the female holding hole 45. Further, the outer diameter of the female conductive member 49 is sufficiently larger than a height from the lowermost end of the holding recess 47 to an opening edge of the female holding hole in the upper surface of the resilient holding piece 44 in a state where the resilient pressing piece 46 and the resilient holding piece 44 are not displaced resiliently.

The female conductive member 49 is placed on the upper surface of the holding recess 47 with the resilient pressing piece 46 resiliently displaced downward, and positioned with respect to the resilient pressing piece 46 in the front-rear direction and lateral direction. The female conductive member 49 placed in the holding recess 47 is pressed resiliently against the inner peripheral surface of the female holding hole 45 by a resilient restoring force (biasing) of the resilient pressing piece 46. Further, the resilient holding piece 44 also is displaced slightly up by the biasing of the resilient pressing piece 46. An upper end part of the female conductive member 49 projects up from the upper surface of the resilient holding piece 44 in the female holding hole 45.

With the female conductive member 49 held in contact with the inner peripheral surface of the female holding hole 45 by the biasing of the resilient pressing piece 46 and the resilient holding piece 44 slightly resiliently displaced upward by the biasing of the resilient pressing piece 46, a vertical interval between the upper end of the female conductive member 49 and the lower surface of the pressure receiving portion 43 is slightly smaller than a height from the lower surface of the tab 13 to the upper end of the male conductive member 20. The tab 13 of the male terminal fitting 10 is inserted between the upper end of the female conductive member 49 and the pressure receiving portion 43.

The upward separation of the female conductive member 49 from the resilient holding piece 44 is restricted and large relative displacements thereof in the front-rear direction and lateral direction with respect to the resilient holding piece 44 are restricted. The female conductive member 49 is relatively rotatable with respect to the rectangular tube 39 in a three-dimensionally manner. When rotating with respect to the rectangular tube 39, the female conductive member 49 slides in contact with the upper surface of the holding recess 47 and the inner peripheral surface of the female holding hole 45.

In connecting the male terminal fitting 10 and the female terminal fitting 37, the tab 13 is inserted into the rectangular tube 39. The inserted tab 13 slides in contact with a guiding slope 44S in a front area of the resilient holding piece 44, thereby being guided between the pressure receiving portion 43 and the resilient holding piece 44. In the process of inserting the tab 13 between the pressure receiving portion 43 and the resilient holding piece 44, the resilient pressing piece 46 presses the female conductive member 49 up by the resilient restoring force thereof. Thus, the female conductive member 49 presses the tab 13 upward, and the tab 13 presses the pressure receiving portion 43 upward via the male conductive member 20.

That is, the tab 13 is sandwiched resiliently between the resilient pressing piece 46 and the pressure receiving portion 43 via the male conductive member 20 and the female conductive member 49. The tab 13, the male conductive member 20 and the female conductive member 49 are sandwiched resiliently between the resilient pressing piece 46 and the pressure receiving portion 43. Thus, the upper end of the male conductive member 20 contacts the lower surface of the pressure receiving portion 43 while rolling and the upper end of the female conductive member 49 contacts the lower surface of the tab 13 while rolling in the inserting process of the tab 13.

Rolling friction when the male conductive member 20 rolls is smaller than friction caused when the male conductive member 20 is not provided and the tab 13 directly slides in contact with the pressure receiving portion 43. Rolling friction when the female conductive member 49 rolls is smaller than friction caused when the female conductive member 49 and the resilient holding piece 44 are not provided and the tab 13 directly slides in contact with the resilient pressing piece 46.

If the tab 13 is inserted to a predetermined position in the rectangular tube 39, the male terminal fitting 10 and the female terminal fitting 37 are connected conductively. At this time, the resilient restoring force (biasing force) of the resilient pressing piece 46 directly acts on the female conductive member 49 and the female conductive member 49 resiliently contacts the tab 13. In this way, the tab 13 and the resilient pressing piece 46 are connected conductively via the female conductive member 49. Further, the male conductive member 20 resiliently contacts the tab 13 and the pressure receiving portion 43 due to a resilient pressing force of the female conductive member 49 pressing the tab 13. In this way, the tab 13 and the pressure receiving portion 43 are connected conductively via the male conductive member 20. The resilient pressing piece 46 and the tab 13 remain out of contact with each other.

As described above, the male terminal fitting 10 constituting the terminal connection structure of the second embodiment includes the tab 13 to be inserted into the rectangular tube 39 of the female terminal fitting 37. The female terminal fitting 37 constituting the terminal connection structure together with the male terminal fitting 10 includes the resilient pressing piece 46 and the pressure receiving portion 43 inside the rectangular tube 39. The tab 13 is sandwiched resiliently between the resilient pressing piece 46 and the pressure receiving portion 43 inside the rectangular tube 39 so that the male terminal fitting 10 and the female terminal fitting 37 are connected conductively.

The male conductive member 20 capable of resiliently contacting the pressure receiving portion 43 while rolling is mounted in the tab 13. The female terminal fitting 37 is provided with the female conductive member 49 capable of resiliently contacting the tab 13 by the biasing of the resilient pressing piece 46. The female conductive member 49 contacts the tab 13 by the biasing of the resilient pressing piece 46 while rolling.

According to this configuration, in the process of inserting or withdrawing the tab 13 into or from the rectangular tube 39, the male conductive member 20 mounted in the tab 13 contacts the pressure receiving portion 43 while rolling, and the female conductive member 49 biased by the resilient pressing piece 46 contacts the tab 13 while rolling. Thus, as compared to the case where the tab 13 slides in contact with both the pressure receiving portion 43 and the resilient pressing piece 46, friction resistance is smaller in the terminal connection structure of the second embodiment. In this way, even if the tab 13 frequently is inserted into and withdrawn from the rectangular tube 39, the abrasion of plating layers of the tab 13, the pressure receiving portion 43 and the resilient pressing piece 46 is reduced. Therefore, the male terminal fitting 10 and the female terminal fitting 37 of the second embodiment are excellent in abrasion resistance.

Further, since the male conductive member 20 is a spherical body, even if the tab 13 is inserted into or withdrawn from the rectangular tube 39 in an oblique direction, the male conductive member 20 can continue to roll with an axis of rotation inclined with respect to the lateral direction. Thus, a rolling motion of the male conductive member 20 is not obstructed. Similarly, since the female conductive member 49 is also a spherical body, even if the tab 13 is inserted into or withdrawn from the rectangular tube 39 in an oblique direction, the female conductive member 49 can continue to roll with an axis of rotation inclined with respect to the lateral direction. Thus, a rolling motion of the female conductive member 49 is not obstructed.

The invention is not limited to the above described and illustrated embodiments. For example, the following embodiments also are included in the scope of the invention.

Although the male conductive member is a spherical body in the above first and second embodiments, the male conductive member may be a solid cylindrical body or hollow cylindrical body.

Although the female conductive member is a spherical body in the above first and second embodiments, the female conductive member may be a solid cylindrical body or hollow cylindrical body.

Although only the male conductive member configured to contact the pressure receiving portion is mounted in the tab in the above first and second embodiments, a male conductive member configured to contact the pressure receiving portion and a male conductive member configured to contact the female conductive member may be mounted in the tab or a male conductive member configured to contact the female conductive member may be mounted in the tab according to the first aspect of the invention.

Although the female conductive member is mounted in the holding portions of the female terminal fitting in the first embodiment, the holding portions and the female conductive member may not be provided and the resilient pressing piece may directly face the tab according to the first aspect of the invention. In this case, the male conductive member mounted in the tab may be caused to directly contact the resilient pressing piece while rolling.

Although the female conductive member is mounted in the resilient holding piece of the female terminal fitting in the second embodiment, the resilient holding piece and the female conductive member may not be provided according to the first aspect of the invention. In this case, the male conductive member mounted in the tab may be caused to directly contact the resilient pressing piece while rolling.

Although one male conductive member is mounted in the lab in the above first and second embodiments, a plurality of male conductive members may be mounted side by side in the inserting and withdrawing directions of the tab according to the first aspect of the invention.

Although the male conductive member is mounted in the tab of the male terminal fitting in the above first and second embodiments, the male conductive member may not be mounted in the tab in the male terminal fitting according to the second aspect of the invention.

Although the female conductive member of the female terminal fitting is disposed between the tab and the resilient pressing piece so that the biasing force of the resilient pressing piece directly acts on the female conductive member in the above first and second embodiments, the female conductive member may be mounted in the pressure receiving portion and the biasing force of the resilient pressing piece may act on the female conductive member via the tab according to the second aspect of the invention.

Although one female conductive member is mounted in the rectangular tube in the above first and second embodiments, plural female conductive members may be mounted side by side in the inserting and withdrawing directions of the tab according to the second aspect of the invention.

LIST OF REFERENCE SIGNS

10 . . . male terminal fitting
13 . . . tab
15 . . . base plate
16 . . . upper plate
19 . . . male holding hole (holding hole)
20 . . . male conductive member (conductive member)
21, 37 . . . female terminal fitting
23, 39 . . . rectangular tube
28, 43 . . . pressure receiving portion
29 . . . holding portion
33 . . . female holding hole (holding hole)
34, 46 . . . resilient pressing piece
36, 49 . . . female conductive member (conductive member)

The invention claimed is:

1. A male terminal fitting, comprising:

a tab to be inserted into a rectangular tube of a female terminal fitting, the male terminal fitting being connected to the female terminal fitting by the tab inserted into the rectangular tube being resiliently sandwiched between a resilient pressing piece provided in the rectangular tube and a pressure receiving portion provided in the rectangular tube; and a spherical body formed from a conductive material and being mounted in the tab so that the spherical body projects from a surface of the tab, the spherical body being rollable relative to the tab and being capable of resiliently contacting the pressure receiving portion or the resilient pressing piece while rolling.

2. The male terminal fitting of claim 1, wherein:

the tab has a double-plate structure including a base plate configured to face the resilient pressing piece and an upper plate portion configured to face the pressure receiving portion, the upper plate portion is formed with a tapered holding hole configured to face the pressure receiving portion, and the spherical body is held in the tab while being in contact with the base plate and an inner peripheral surface of the holding hole with a portion of the spherical body projecting upward through the holding hole and beyond the upper plate portion.

3. The male terminal fitting of claim 1, wherein the spherical body is formed separately from the tab.

4. A female terminal fitting, comprising:

a rectangular tube having a resilient pressing piece, a resilient holding piece and a pressure receiving portion provided inside, a tab of a male terminal fitting being inserted between the pressure receiving portion and the resilient holding piece, the female terminal fitting being connected to the male terminal fitting by resiliently sandwiching the tab between the resilient pressing piece and the pressure receiving portion; and a conductive member capable of resiliently coming into contact with the tab by biasing of the resilient pressing piece, the conductive member being capable of contacting the tab while rolling, the conductive member being provided in a state resiliently sandwiched between the resilient holding piece and the resilient pressing piece.

5. The female terminal fitting of claim 4, wherein the conductive member is a spherical body.

6. A male terminal fitting, comprising:

a tab to be inserted into a rectangular tube of a female terminal fitting, the male terminal fitting being connected to the female terminal fitting by the tab inserted into the rectangular tube being resiliently sandwiched between a resilient pressing piece provided in the rectangular tube and a pressure receiving portion provided in the rectangular tube; and a conductive member mounted in the tab and capable of resiliently contacting the pressure receiving portion or the resilient pressing piece while rolling, wherein:

the tab has a double-plate structure including a base plate configured to face the resilient pressing piece and an upper plate portion configured to face the pressure receiving portion, the upper plate portion is formed with a tapered holding hole configured to face the pressure receiving portion, and the conductive member is held in the tab while being in contact with the base plate and an inner peripheral surface of the holding hole.

7. The male terminal fitting of claim 6, wherein the conductive member is a spherical body.

* * * * *